US012442625B2

(12) United States Patent
Biedermann et al.

(10) Patent No.: US 12,442,625 B2
(45) Date of Patent: Oct. 14, 2025

(54) CARTRIDGE CASE AND TOOL FOR JOINING THE BASE PIECE AND CASE JACKET OF A MULTI-PART CARTRIDGE CASE

(71) Applicant: RUAG Ammotec AG, Thun (CH)

(72) Inventors: Peter Biedermann, Lyss (CH); Peter Spatz, Bern (CH)

(73) Assignee: RUAG Ammotec AG, Thun (CH)

( * ) Notice: Subject to any disclaimer, the term of this patent is extended or adjusted under 35 U.S.C. 154(b) by 76 days.

(21) Appl. No.: 18/246,076

(22) PCT Filed: Jul. 5, 2021

(86) PCT No.: PCT/EP2021/068537
§ 371 (c)(1),
(2) Date: Mar. 21, 2023

(87) PCT Pub. No.: WO2022/058062
PCT Pub. Date: Mar. 24, 2022

(65) Prior Publication Data

US 2023/0366661 A1 Nov. 16, 2023

(30) Foreign Application Priority Data

Sep. 21, 2020 (DE) ..... 102020124559.9

(51) Int. Cl.
*F42B 5/285* (2006.01)
*F42B 33/00* (2006.01)

(52) U.S. Cl.
CPC ..... *F42B 5/285* (2013.01); *F42B 33/001* (2013.01)

(58) Field of Classification Search
CPC .... F42B 5/26; F42B 5/28; F42B 5/285; F42B 33/00; F42B 33/001
(Continued)

(56) References Cited

U.S. PATENT DOCUMENTS 3,099,958 A 8/1963 Daubenspeck et al.
3,369,443 A 2/1968 Shansey
(Continued)

FOREIGN PATENT DOCUMENTS

DE 2205619 A1 8/1972
DE 68928894 T2 7/1999
(Continued)

OTHER PUBLICATIONS

Sep. 24, 2024 (EP) Office Action—App. 21740486.2.
(Continued)

*Primary Examiner* — James S Bergin
(74) *Attorney, Agent, or Firm* — Banner & Witcoff Ltd.

(57) ABSTRACT

A cartridge case for ammunition may include a rotationally shaped case jacket for receiving a projectile and an annular base piece for receiving a primer and the case jacket. An annular wall of the base piece on the side of the case jacket is conically shaped at least in sections with respect to its axis of rotation. A retaining section of the case jacket on the side of the base piece is adapted in shape thereto so that the retaining section engages at least in sections behind the annular wall for fastening the case jacket and the base piece to one another. A distancing of the base piece and case jacket from each other may be prevented in the direction of the axis of rotation. The conical annular wall and the retaining section may be formed by plastic deformation of the base piece.

11 Claims, 6 Drawing Sheets

(58) Field of Classification Search
USPC ..... 102/464, 469, 470
See application file for complete search history.

(56) References Cited

U.S. PATENT DOCUMENTS

| | | | | |
|---|---|---|---|---|
| 3,706,118 | A | 12/1972 | Hilton et al. | |
| 5,033,386 | A * | 7/1991 | Vatsvog | F42B 5/307 102/467 |
| 5,259,288 | A | 11/1993 | Vatsvog | |
| 10,866,072 | B2 * | 12/2020 | Imhoff | F42B 5/285 |
| 11,067,370 | B2 * | 7/2021 | Imhoff | F42B 5/285 |
| 12,031,806 | B2 * | 7/2024 | Biedermann | F42B 5/36 |
| 2015/0174643 | A1 | 6/2015 | Hay et al. | |
| 2020/0158480 | A1 | 5/2020 | Routhier et al. | |
| 2020/0182594 | A1 | 6/2020 | Imhoff et al. | |
| 2024/0377172 | A1 * | 11/2024 | Biedermann | B21K 21/14 |

FOREIGN PATENT DOCUMENTS

| | | | |
|---|---|---|---|
| FR | 861071 | A | 1/1941 |
| FR | 1113479 | A | 3/1956 |
| WO | 2008091245 | A2 | 7/2008 |
| WO | 2020028187 | A1 | 2/2020 |

OTHER PUBLICATIONS

Dec. 6, 2021 (PCT) International Search Report—App. PCT/EP2021/068537.
Nov. 8, 2023 (DE) Office Action—App. 102020124559.9.

* cited by examiner

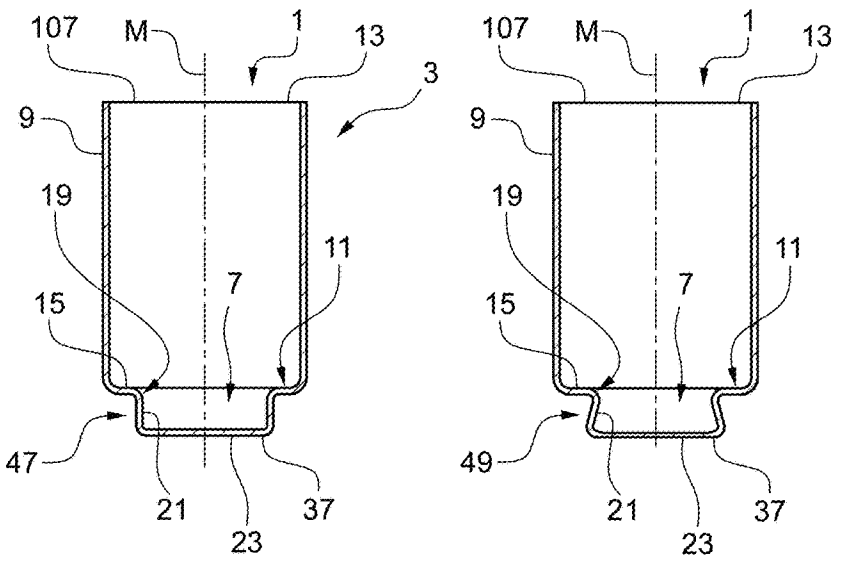
Fig. 3
Fig. 4
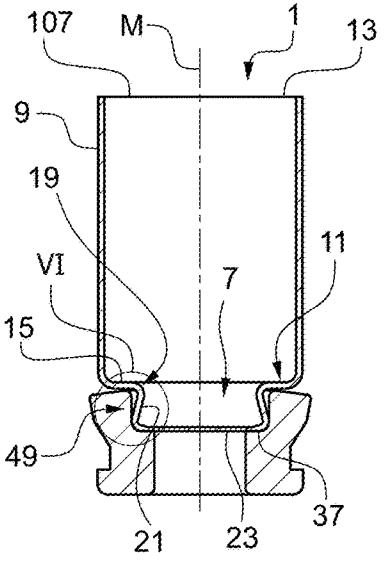
Fig. 5
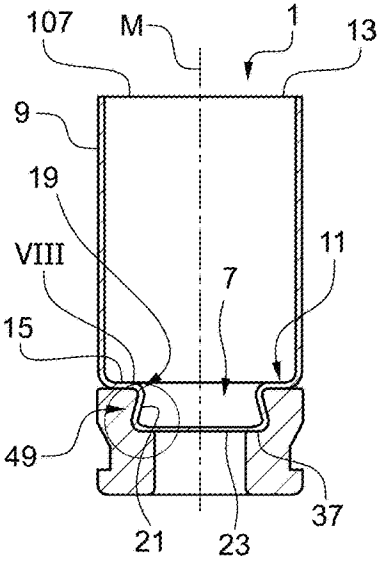
Fig. 7
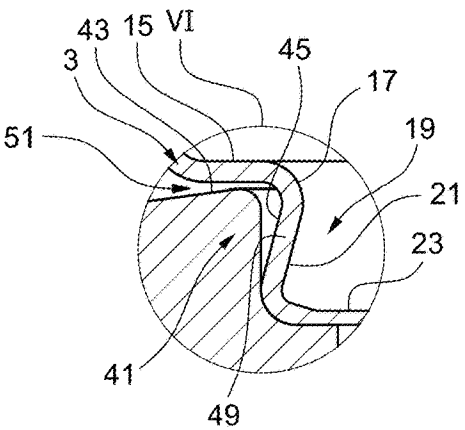
Fig. 6
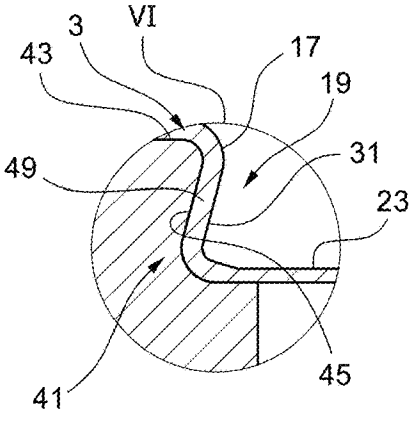
Fig. 8

CARTRIDGE CASE AND TOOL FOR JOINING THE BASE PIECE AND CASE JACKET OF A MULTI-PART CARTRIDGE CASE

CROSS REFERENCE TO RELATED APPLICATIONS

This patent application is a U.S. National Stage Application of PCT/EP2021/068537, filed on Jul. 5, 2021, which claims priority to German Patent Application No. 10 2020 124 559.9, filed Sep. 21, 2020, each of which is incorporated herein by reference in its entirety.

BACKGROUND

Field

The present disclosure relates to a multi-piece cartridge case for ammunition and ammunition. Furthermore, the present disclosure relates to a method and a tool for joining a base piece and a case jacket of a multi-part cartridge case.

Related Art

Multi-part cartridge cases are known in principle and are subdivided at least into a base piece facing the primer and a case jacket firmly connected to the base piece. However, the known methods for joining the base piece and case jacket have proven to be improvable, particularly with regard to mass production and automation.

For example, FR 1113479 discloses a 3-piece cartridge case comprising a base piece, a case jacket, and a fastener. FR 1113479 proposes two different ways to fasten the base piece and case jacket together. One configuration provides for insertion of the fastening part on the inside in the longitudinal direction of the case jacket when the case jacket is inserted in the base piece, which causes radial expansion of an open end section of the case jacket facing the base piece. The radial expansion of the open end section of the case jacket causes a radially outwardly projecting latching projection to engage in a recess provided in an inner wall of the base piece, so that the case jacket and the base piece get fastened to one another. In an alternative configuration, the base piece and case jacket are secured by the radially outer base piece having a funnel-shaped boundary wall which widens in the direction of the case jacket. To fasten the base piece and case jacket, the boundary wall is deformed radially inwards until the boundary wall has a cylindrical shape. This is accompanied by a deformation of the open end section of the case jacket received in the base piece, so that a radially inwardly extending latching projection provided on the open end section can latch into a radial groove provided in the radially inwardly located fastening part. At the same time, a fastening of the fastening part to the base piece is also formed. At FR 1113479, the complex manufacture of the cartridge sleeve has proved to be disadvantageous. On the one hand, an additional fastening part is necessary to realize the fastening between the base piece and the case jacket. For another, the undercut features for the form or force fit must be prefabricated.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIGS. 3 to 8 illustrate a schematic representation of a manufacturing sequence of a cartridge case according to an exemplary embodiment of the disclosure, with FIGS. 6 and 8 being detailed views of the cutouts VI of FIG. 5 and VIII of FIG. 7, respectively.

Figure 1:
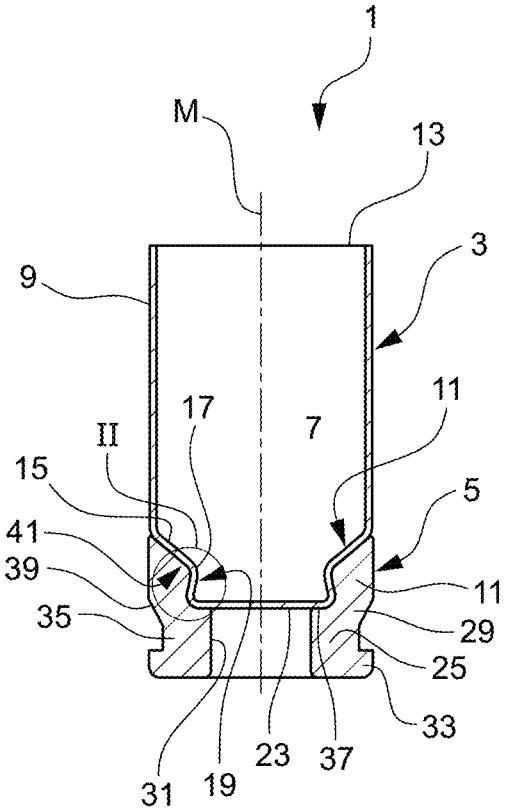
FIG. 1 is a sectional view of a cartridge case according to an exemplary embodiment of the disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, and components have not been described in detail to avoid unnecessarily obscuring embodiments of the disclosure.

An object of the present disclosure is to overcome the disadvantages of the prior art, in particular to create a multi-part cartridge case which can be manufactured simply and inexpensively and which is also suitable in particular for mass and/or automated production.

According thereto, a cartridge case for ammunition is provided. For example, the ammunition has a caliber in the range from 4.6 to 12.7. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally include at least a primer base facing the primer and a case jacket fixedly connected to the primer base.

The cartridge case according to one or more exemplary embodiments of the disclosure may include a rotational case jacket for receiving a projectile and an annular base piece for receiving a primer and the case jacket. The base piece may include a central recess in which the case jacket is partially received. When the case jacket and base piece are attached to each other, an outer surface of the case jacket abuts an inner surface of the base piece, particularly the recess. The base piece may define an axis of rotation.

A sleeve-shell-side annular wall of the base piece is conically shaped at least in sections with respect to its axis of rotation. Furthermore, a base piece-side retaining section of the case jacket is adapted in shape with respect to the conical annular wall, so that the retaining section engages behind the annular wall at least in sections for fastening the case jacket and base piece to one another, and distancing of the base piece and case jacket from each other in the direction of the axis of rotation and/or in the direction of torsion is prevented. According to one or more exemplary embodiments of the disclosure, the conical ring wall and the retaining section may be formed by plastic deformation of the base piece, and in particular of the case jacket. The plastic deformation can be affected by applying force from radially outside, in particular by pressing. In this way, a particularly simple and inexpensive cartridge case is created. In particular, a form and/or force fit between base piece and case jacket can be achieved in this way. The plastic deformation of the base piece can cause an interlock between the base piece and the case jacket, in particular in such a way that the case jacket is retained in the base piece and/or an axial and/or rotational relative movement between the case jacket and the base piece is avoided. A further advantage of the realization of the fastening between the case jacket and the base piece according to the disclosure is that the fastening between the case jacket and the base piece is reinforced when the ammunition is fired by a firearm. For example, a more extensive plastic deformation may accompany it, which strengthens the hooking or engagement structure. In other words, in the cartridge case according to one or more exemplary embodiments of the disclosure, a force-locking and/or form-locking fastening of the base piece and the case jacket is possible by performing deformation work. Neither the case jacket nor the base piece requires additionally introduced and/or prefabricated fastening and/or hooking structures. By the fact that the recess inner wall tapers towards the case jacket, it can be understood that a free or open opening cross-section of the recess is reduced. In other words, the inner wall may be inclined with respect to the center axis of rotation. The plastic deformation of the base piece can be demonstrated, for example, in the flow structure. Furthermore, according to the disclosure, a particularly good gas tightness is provided, which is essential when firing the ammunition and for the resulting gas pressure.

In an exemplary embodiment of the cartridge case according to the disclosure, the plastic deformation of the annular wall takes place in such a way that the base piece forms an undercut feature and the case jacket is deformed to form an undercut, in particular is plastically deformed. For example, the formation of the undercut feature can occur simultaneously with the formation of the undercut feature as a result of the plastic deformation of the base piece. According to an exemplary further embodiment, the undercut is in a fastening engagement with the undercut feature. Alternatively, or additionally, the undercut may be form-fitted to the undercut feature at least in sections. Furthermore, the inner wall of the base piece having the undercut feature may be in contact with an outer wall of the case jacket having the undercut, in particular in full-surface abutment with each other. For example, an outer contour of the case jacket follows the inner contour, which is defined by the inner wall, of the base piece at least in the region of the undercut feature or the undercut. Furthermore, it is possible for the outer contour of the case jacket to follow the inner contour of the base piece even when viewed axially beyond the undercut feature or undercut, in particular the base piece and case jacket can have support shoulders facing each other and in particular in contact with each other over their entire surface. The deformed case jacket can build up a deformation restoring force counteracting the deformation accompanying the deformation of the undercut, which strengthens the fastening of the base piece and case jacket by the force/form fit. The deformation restoring force can cause an additional, in particular radially directed, pressing together of the base piece and case jacket.

In another exemplary embodiment of the present disclosure, the base piece comprises a case section facing away from the case jacket and a bending wing adjoining the case section. The bending wing may be made in one piece with the case section. The bending wing may comprise the annular wall forming the undercut feature or be bounded by it radially on the inside. In other words, the attachment of the base piece and the case jacket to each other can be achieved by plastic deformation, in particular bending, of the bending wing. The case section may have a central through opening which opens into the central recess.

According to an exemplary further development of the cartridge case according to the disclosure, the bending wing is connected to the case section via a pivot coupling and/or a predetermined folding point. For example, the pivot coupling and/or the predetermined folding point is arranged to cause the bending wing to bend relative to the case section when a force is applied to the bending wing from the outside, so that the bending wing can be bent radially inward to form an undercut feature. According to an exemplary further development, the bending wing, the pivot coupling and/or the predetermined folding point and the case section are made from a single piece. Alternatively, or additionally, the pivot coupling can be implemented as a film hinge. For example, the film hinge may be characterized by having a smaller wall thickness than the adjacent case section, or the adjacent bending wing.

In an exemplary embodiment of the present disclosure, the case jacket includes a hollow cylindrical section and an adjacent neck section that is tapered in cross-section with respect to the cylindrical section. In general, the case jacket may have a substantially constant or tapered wall thickness along its entire length. The wall thickness may be thin-walled, particularly significantly less than its longitudinal dimension. The neck section may be closed at least in sections on its underside facing the base piece. For example, the neck section has a thin-walled, planar base wall, which consists of solid material for at least 30%, in particular at least 40% or at least 50%, of the area of the base. Accordingly, in cross-section, the case jacket may be substantially U-shaped. Further, it is possible to provide the base with priming bores, accordingly partially open, reinforcing ribs or the like.

According to a further exemplary embodiment of the cartridge case according to the disclosure, the case jacket comprises a hollow cylinder section and a neck section adjoining the cylinder section and tapering in cross-section with respect to the cylinder section. The neck section can have a support shoulder, extending at least also radially, for the base piece, in particular its bending wing. The support shoulder can additionally have an axial extension component. The support shoulder can open into a conical section widening in cross section in the direction of the base piece. For example, the conical section comprises the undercut. In particular, the conical section may have a frustoconical shape in cross-section. In other words, the conical section may be generated by deformation. The plastic deformation of the bending wing, in particular the bending radially inward, causes deformation of the case jacket in its neck section such that the undercut is formed. The bending wing can be designed and/or set up in such a way that, during radially inward bending, it comes into contact with a section of the case jacket adjoining the support shoulder and causes deformation of the latter. This section can, for example, be cylindrical or already have a certain conical shape, which may be further reinforced as a result of the force applied by the bending wing.

In general, an advantage of the present disclosure is the ease of manufacture of the cartridge case, which is thus well suited for mass and/or automated production. According to one or more exemplary embodiments of the present disclosure, the work and/or structural features required to secure the case jacket and the base piece can be generated entirely during the joining of the two components together, namely by the plastic deformation of the base piece inner wall and, in particular, the concomitant deformation of a section of the case jacket associated with and/or facing the base piece inner wall.

According to another aspect of the present disclosure, which is combinable with the preceding aspects and exemplary embodiments, a cartridge case for ammunition is provided. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally include at least a base piece facing the primer and a case jacket fixedly connected to the base piece.

The cartridge case according to one or more exemplary embodiments of the disclosure may include an annular base piece for receiving a primer and a rotationally shaped case jacket for receiving a projectile. According to this aspect of the disclosure, the base piece is manufactured by deforming, in particular non-chipping deforming, punching or chipping. It should be understood that further manufacturing steps may also be necessary. In any case, at least one manufacturing step for producing an inner and/or outer geometry of the base piece may be performed by punching. The present disclosure overcomes the widespread prejudice that punching is unsuitable in the field of ammunition technology, in particular in the manufacture of cartridge cases, especially base pieces for cartridge cases, because of the high manufacturing tolerances. The inventors of the present disclosure have now been able to overcome this prejudice and produce the base piece by punching. As a result, manufacturing efficiency can be significantly increased. In particular, the manufacturing performance can be greatly improved, so that the manufacturing costs can be significantly reduced, in particular by about 30%. The manufacture of the cartridge cases is thus significantly more suitable for mass and/or automated production.

In an exemplary embodiment of the cartridge case according to the disclosure, the base piece may include an annular jacket and a through-bore extending through the jacket, in particular a receiving bore for the primer, the through-bore being produced at least in sections by punching. In other words, an inner geometry of the base piece may be produced at least in sections by punching.

In another exemplary embodiment of the present disclosure, a bow section on the side of the case jacket having a recess for receiving the case jacket is formed after punching by cold forming, in particular by backwards extrusion. Alternatively, or additionally, a stern section on the side of the primer may be formed with an opening for receiving the primer after punching by cold forming, in particular by backwards extrusion. For example, the internal geometry of the base piece, in particular the wall defining the through bore, is produced without any post-processing steps.

According to another aspect of the present disclosure, which is combinable with the preceding aspects and exemplary embodiments, a cartridge case for ammunition is provided. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally include at least a base piece facing the primer and a case jacket fixedly connected to the base piece.

The cartridge case according to one or more exemplary embodiments of the disclosure comprises an annular base piece for receiving a primer and a rotationally shaped case jacket for receiving a projectile. The case jacket includes a circumferential jacked and an at least partially closed base facing the base piece. The base may be substantially completely closed, wherein substantially completely closed is to be understood in that ignition hole bores for the primer are provided.

Further, the case jacket and the base piece are attached to each other by plastic deformation of the base piece, and in particular also the case jacket. The closed base of the case jacket allows easy manufacturing of the cartridge case, in particular easy joining of the case jacket and the base piece. Because the base is closed, it is not necessary to use a punch or the like to provide a counterforce when plastically deforming the base piece, and in particular also the case jacket. The counterforce is achieved via the closed structure of the case jacket. A further advantage arises above all when the base piece is produced by punching. The production-related tolerances during punching are compensated for or are irrelevant as a result of the subsequent plastic deformation of the base piece, since the dimension of the base piece produced during punching is not important.

In an exemplary embodiment of the present disclosure, the base comprises a thin-walled, planar wall. At least 30%, and more particularly at least 40% or at least 50%, of the area of the wall comprises solid material.

According to a further aspect of the present disclosure, combinable with the preceding aspects and exemplary embodiments, ammunition is provided. The ammunition according to the present disclosure comprises a cartridge case according to the present disclosure, which may be formed according to any of the previously described aspects or exemplary embodiments, and a primer received in the base piece and/or a projectile received in the case jacket.

According to another aspect of the present disclosure, which is combinable with the foregoing aspects and exemplary embodiments, there is provided a method of joining a base piece and a case jacket of a multi-part cartridge case, particularly according to any of the foregoing aspects and/or exemplary embodiments. The explanations with respect to the cartridge case according to the disclosure apply analogously and correspondingly to the joining method according to the disclosure. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally include at least a base piece facing the primer and a case jacket fixedly connected to the base piece.

In a method of one or more exemplary embodiments of the disclosure, the base piece and the case jacket are pushed telescopically into one another or into one another. The base piece and the case jacket can be dimensioned with respect to each other in such a way that there is an interference fit. According to one or more exemplary embodiments of the disclosure, the base piece and the case jacket are then plastically deformed in such a way that the case jacket and the base piece engage behind one another, so that distancing of the base piece and case jacket from each other in the insertion direction and/or in the rotational direction is prevented. According to the process, a cartridge case can be produced in a particularly simple and cost-effective manner. In particular, a form and/or force fit between the base piece and the case jacket can be easily achieved in this way. The plastic deformation of the base piece can cause an interlock between the base piece and the case jacket, in particular in such a way that the case jacket is retained in the base piece and/or an axial relative movement between the case jacket and the base piece is avoided. A further advantage of the realization of the fastening between the case jacket and the base piece according to the disclosure is that the fastening between the case jacket and the base piece is reinforced when the ammunition is fired by a firearm. For example, a more extensive plastic deformation may accompany it, which strengthens the hooking or engagement structure. In other words, in the cartridge case according to the disclosure, a force-locking and/or form-locking fastening of the base piece and the case jacket is possible by performing deformation work. Neither the case jacket nor the base piece requires additionally introduced and/or prefabricated fastening and/or hooking structures. In an exemplary embodiment of the method according to the disclosure, the case jacket is deformed during the formation of the undercut feature, forming an undercut. For example, the undercut may be brought into a fastening engagement with the undercut feature and/or may be form-fitted to the undercut feature at least in sections.

In an exemplary embodiment of the method according to the disclosure, an undercut feature is formed when the base piece is deformed and an undercut feature is formed when the case jacket is deformed, in particular by plastic deformation. For example, the formation of the undercut can occur simultaneously with the formation of the undercut feature as a result of the plastic deformation of the base piece. According to an exemplary further development, the undercut is brought into a fastening engagement with the undercut feature. Alternatively, or additionally, the undercut can be form-fitted to the undercut feature at least in sections.

According to an exemplary further development of the process according to the disclosure, the base piece is pressed from radially outside, in particular compressed and/or pressed radially inwards, to form the undercut feature, in particular to simultaneously form the undercut. By pressing the base piece from radially outside, the base piece is plastically deformed.

The plastic deformation of the base piece can take place in such a way that the base piece transmits the deformation force to the case jacket, so that the latter is also deformed. In the case where the case jacket is inserted in the base piece in an oversize, the deformation of the case jacket may start with a time delay with respect to the plastic deformation of the base piece.

According to another exemplary embodiment of the joining method according to the disclosure, a bending wing of the base piece facing the case jacket is bent radially inward about a pivot coupling connecting the bending wing to a case section of the base piece, in particular a predetermined folding point and/or a film hinge, to form the undercut feature. For example, the base piece can be deformed so that one section, namely the bending wing, is bent over and another section, namely the case section, remains substantially undeformed. In this manner, pivoting of the bending wing relative to the case section is accompanied.

According to an exemplary further embodiment of the method according to the disclosure, the method is adapted to produce a cartridge case formed according to one of the preceding aspects or exemplary embodiments.

According to a further exemplary embodiment of the method according to the disclosure, the base piece is produced by deforming, in particular non-chipping deforming, punching or chipping. Furthermore, the base piece and the case jacket are telescopically pushed into each other and fastened to each other. The fastening to one another can be affected by plastic deformation of the base piece, and in particular also of the case jacket.

In an exemplary further embodiment of the method according to the present disclosure, the method is adapted to produce a cartridge case according to the present disclosure in accordance with one of the aspects or exemplary embodiments described above.

According to a further aspect of the present disclosure, which is combinable with the preceding aspects and exemplary embodiments, there is provided a tool for joining in a base piece and a case jacket of a multi-part cartridge case, in particular according to one of the preceding aspects or exemplary embodiments. Ammunition, also referred to as a cartridge, generally comprises the following components: a cartridge case; a primer for igniting the propellant powder; a propellant charge as an energy carrier; and a projectile to be fired from a firearm. Multi-part cartridge cases typically include at least one base piece facing the primer and a case jacket fixedly connected to the base piece.

In one or more exemplary embodiments, the tool may be adapted to perform a pressure forming process. The tool may include a shaping die for receiving at least the base piece. According to one or more exemplary embodiments of the disclosure, the shaping die is shaped in such a way that, during an axial pressing movement of the base piece and the case jacket as well as the shaping die and, if appropriate, a press plunger relative to one another, the base piece is plastically deformed in such a way that the case jacket and the base piece engage behind one another, so that distancing of the base piece and the case jacket from each other in the pressing direction is prevented. The die can be set up in such a way that the base piece and the case jacket are held axially in position and the shaping die executes the axial relative movement. The tool may further be set up the other way around. Furthermore, the tool may comprise a counter die substantially adapted to an inner contour of the case jacket, which in particular acts as a counter bearing for the shaping die. The counter die may have a cylindrical cylinder counter section adapted to the cylindrical section of the case jacket, and a cylindrical neck counter section substantially form-fitted to the neck section and smaller in cross-section than the cylinder counter section. The neck counter section is smaller in dimension with respect to the neck section, such that deformation of the neck section is permitted. The explanations with respect to the cartridge case according to the disclosure or the joining method according to the disclosure apply analogously and correspondingly to the joining tool according to the disclosure.

In an exemplary embodiment of the tool according to the disclosure, the shaping die is of rotationally shaped and has a central shaping opening. The shaping opening is bounded by an opening wall of the shaping die which tapers or widens at least in sections, in particular continuously in cross-section. In other words, the opening wall can be at least in sections in particular continuously frustoconical in shape. The opening wall can thus be inclined with respect to the axial pressing movement. Because of the inclination of the opening wall, which comes into contact with the base piece with the outer contour for shaping the base piece, the plastic deformation of the base piece can be affected during the axial pressing movement via the geometry of the inner wall.

In a further exemplary embodiment of the tool according to the disclosure, the tool is configured in such a way that, in the course of the axial relative pressing movement, the cross section of the opening wall tapers at least in sections, in particular continuously, and/or a deformation work acting on the base piece increases at least in sections, in particular continuously. Due to the in particular continuously tapering opening wall, the base piece becomes increasingly wedged in the forming opening. Thereby, the deformation work can in particular increase continuously. For example, a bending wing of the base piece facing the case jacket is bent radially inward about a pivot coupling, in particular a film hinge, connecting the bending wing to a case section of the base piece to form the undercut feature, in particular to simultaneously form the undercut. The work required to form the undercut feature or the undercut can be referred to as deformation work.

According to one or more exemplary embodiments of the disclosure, the tool may further include a rotational press plunger. The press plunger may be arranged radially between the base piece or the case jacket and the shaping die. Further, the press plunger may have an outer wall or outer contour adapted to the opening wall. For example, the outer wall is shaped form complementary to the opening wall. Alternatively, or additionally, the press plunger may wedge with the opening wall in the course of the axial relative pressing movement in the forming opening. Further, the outer wall may slide along the opening wall during the axial relative pressing motion. For example, in a prefabrication state, the press plunger may be arranged at a radial distance with respect to the base piece or arranged in a contacting relationship therewith. During the axial relative pressing movement, in particular as a result of the tapering opening wall of the shaping opening, the press plunger is forced radially inwards so that it exerts a deformation force on the base piece, in particular its bending wing, in order to bend it radially inwards to form the undercut feature, in particular to simultaneously form the undercut in the case jacket.

In an exemplary embodiment of the disclosure, the press plunger may include at least two, in particular three, four, five or six, in particular identically formed, separate plunger segments. The plunger segments can be distributed, in particular uniformly, in the circumferential direction and form a ring structure. According to a further exemplary embodiment, two adjacent plunger segments in each case are arranged at a distance from one another in the circumferential direction in a prefabrication state. In the course of the axial relative pressing movement, the distance can in particular decrease continuously. The displacement of the plunger segments can be proportional to the deformation work exerted on the base piece. In a final finished state, the separate plunger segments may be in contact with each other, forming a closed annular structure in the circumferential direction.

In an exemplary embodiment of the tool according to the disclosure, the tool is adapted to produce a cartridge case formed in particular according to one of the foregoing aspects or exemplary embodiments by the method according to one of the foregoing aspects or exemplary embodiments.

In the following description of exemplary embodiments of the present disclosure, a cartridge case for ammunition according to the disclosure is generally designated by reference numeral 1. According to exemplary embodiments, a cartridge case 1 may include: a rotationally shaped case jacket 3; and a rotationally shaped base piece 5 having a central recess 7. In the central recess 7, the case jacket 3 is partially received.

Figure 2:
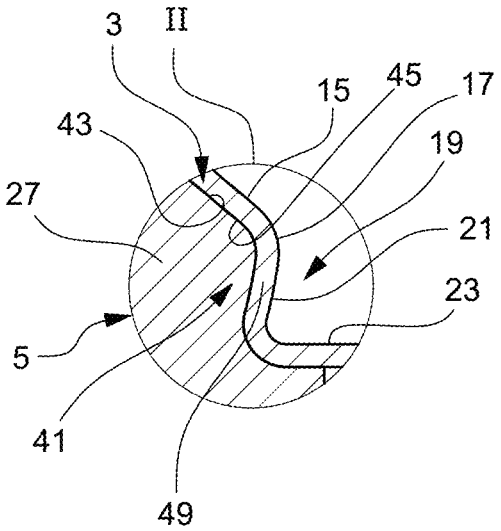
FIG. 2 is a detailed view of section II in FIG. 1.

In FIGS. 1 and 2, a first exemplary embodiment of a cartridge case 1 according to the disclosure is shown in sectional and detailed view. The case jacket is generally made of metal and has a substantially constant wall thickness along its longitudinal extent. The case jacket comprises a hollow, upwardly open cylinder section 9 and an adjoining neck section 11 which is tapered in cross-section with respect to the cylinder section 9. The case jacket 3, in particular the cylinder section 9, is open on a side 13 facing away from the base piece 5.

The neck section 11 according to FIG. 1 comprises a support shoulder 15 inclined with respect to the center axis of rotation M in the direction of the base piece 5, which extends in the radial direction up to a transition 17, which forms the radially innermost point. Starting from the transition 17, the cross-section of the neck section 11 widens again so that an undercut 19 is formed. The neck section on the side of the base piece ridge 21 finally opens into a base 23 of the neck section, which can be of essentially closed design, but in particular can be designed with firing hole bores and/or reinforcing ribs (not shown). As can be seen in FIG. 1, the case jacket, i.e. the cylinder section 9 and the neck section 11, is made in one piece. For example, the case section 11 may be made by deep drawing and prepared for mounting in the base piece 5. The forming of the undercut 19 will be discussed in detail later.

The base piece 5 has a case section 25 facing away from the case jacket 3 and a bending wing 27 adjoining it. The bending wing 27 is coupled to the case section 25 by a pivot coupling, which may be a film hinge, 29 for example. The recess 7 merges into a through opening, which is in particular cylindrically shaped, in the region of the case section 25. The case section 25 comprises a support flange 33 on the side of the bottom facing away from the case jacket 3, which is adjoined by a substantially cylindrical section 35 of reduced wall thickness. On the inside, the cylindrical section 35 opens into a radially extending support web 37 on which the base 23 of the case jacket 3 rests. On the outside, an outer wall 39 of the base piece 5 widens in sections and then extends substantially constantly, i.e. in the direction of the center axis of rotation M.

The bending wing 27 is shaped to form an undercut feature 41. It can further be seen in FIG. 1, and particularly in FIG. 2, that an inner contour 43 of the bending wing 27 is formed substantially complementary in shape to the outer contour 45 of the neck section 11.

The fastening of the case jacket 3 to the base piece 5 is realized by the bending wing 27 of the base piece 5 being plastically deformed, whereby the undercut feature 41 is formed. At the same time, the deformation of the bending wing 27, i.e. its radial inward deforming, in particular about the pivot coupling 29, causes a deformation of the neck section 11 of the case jacket 3, namely to form the undercut 19. In this way, a reliable form and/or force fit is created between the case jacket 3 and the base piece 5 in a manner that is particularly easy to implement in terms of production technology and cost-effectivity.

Exemplary embodiments of tools according to the disclosure, which are generally identified by the reference signs 100, are illustrated in FIGS. 14 to 18, which will be discussed in detail later.

With reference to FIGS. 3 to 8, the joining process for fastening the case jacket 3 and the base piece 5 is illustrated. In FIG. 3, it can be seen that first the case jacket 3 is brought to a prefabrication state in which no undercut feature 9 is yet formed in the region of the neck section 11. As shown in FIG. 3, the cylindrical section 9 of the case jacket 3 passes over a support shoulder 15, extending in particular exclusively radially, into a further cylindrical section 47 of reduced cross-sectional dimension. The case jacket 3 may be produced, for example, by a pressure forming process, in particular cold forming, such as deep drawing. Subsequently, the neck section 11 may be pre-deformed to form an undercut 19. For example, this can be achieved by a pressing process. Referring to FIG. 4, the cylinder section 47 is deformed into a conical section 49 which is substantially frustoconical in cross-section.

With reference to FIG. 5 and in particular to the detailed view according to FIG. 6, it can be seen that the prefabricated and pre-deformed case jacket 3 according to FIG. 4 is then inserted axially into the base piece 5 in a telescopic manner. FIG. 5 shows the prefabricated state of the base piece 5, in which the bending wings 27 are inclined outwardly with respect to the center axis of rotation M. In this respect, there is an oversize of the base piece 5, in particular the bending wing 27, with respect to the case jacket 3, in particular the conical section 49. As can be seen in FIG. 6, the oversize is manifested in a clearance 51 between the inside of the base piece 5 and the outside of the case jacket 3.

With reference to FIGS. 7 and 8, the end fabrication state of the cartridge case 1 is illustrated. It can be seen, particularly with reference to FIG. 8, that the clearance 51 is no longer present. As a result of the plastic deformation of the bending wing 27, in particular its radial inward bending with respect to the pivot coupling 29 and the case section 25, the bending wing 27 now completely occupies the free space 51. Furthermore, it can be seen that the undercut feature 41, which has resulted as a consequence of the plastic deformation of the bending wing 27, is of complementary shape with respect to the undercut 19. The plastic deformation of the bending wing 27 may further be such that the conical section 49, which is already preformed according to FIG. 4, is further deformed so that the formation of the undercut 19 is further reinforced or enlarged. In other words, the sleeve shell flank adjoining the base 23 can be further inclined with respect to axis M.

FIGS. 9 to 13 show a further schematic production sequence. This is essentially similar to that of FIGS. 3 to 8. In this respect, the following description is limited to the resulting differences. The essential difference between the embodiment of FIGS. 9 to 13 and the embodiment of FIGS. 3 to 8 is that the case jacket 3 is not preformed to form a conical section 49 in the region of the neck section 11. The shape of the case jacket 3 inserted telescopically into the base piece (FIG. 10) corresponds essentially to the shape of the case jacket 3 according to FIG. 3, as it is produced, for example, by a deep-drawing process.

Figure 9:
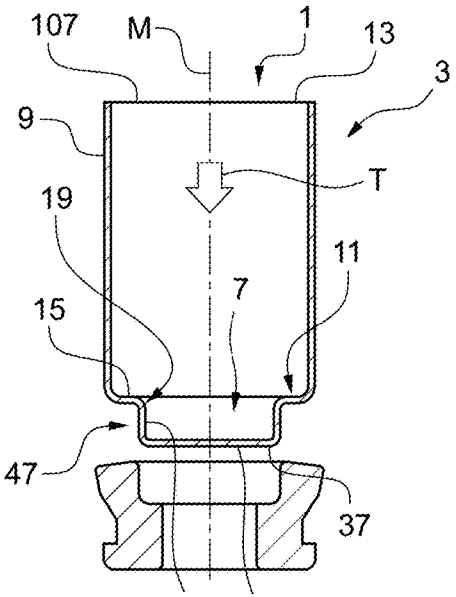

FIG. 9 shows the axial telescopic movement direction. A further difference arises in the inserted pre-assembly state between the case jacket 3 and the base piece 5 shown in FIG. 10. In particular, due to the fact that the case jacket is not preformed to form a conical section 49, no clearance is formed between the outside of the conical section 49 and the inside of the bending wing 27 in the pre-assembly state.

Figure 11:
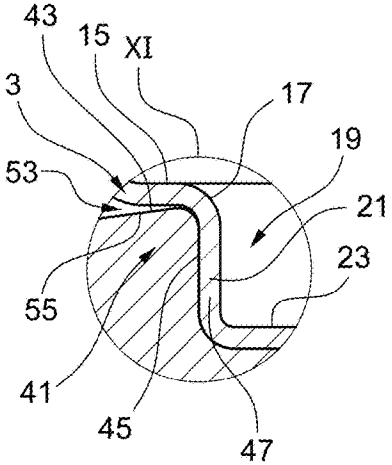

In FIG. 11, it can be seen that the bending wing 27 rests on the inside against the outside of the cylinder section 47. A clearance 53 exists with respect to the support shoulder 15 and an upper end 55 of the bending wing 27, which also acts as a support shoulder.

Figure 12:
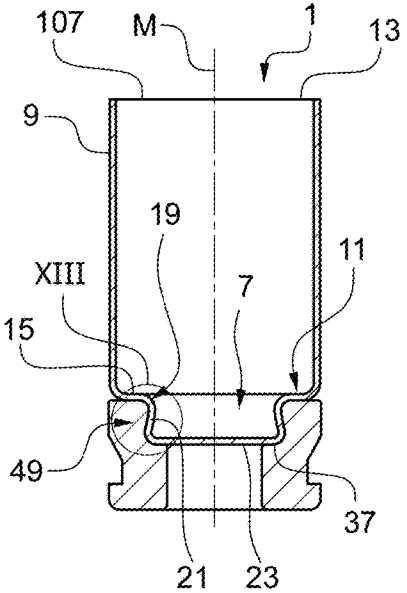
FIGS. 9 to 13 illustrate a schematic representation of a manufacturing sequence for a cartridge case according to an exemplary embodiment of the disclosure, with FIGS. 11 and 13 being schematic detailed views of cutouts XI in FIG. 10 and XIII in FIG. 12, respectively.
Figure 13:
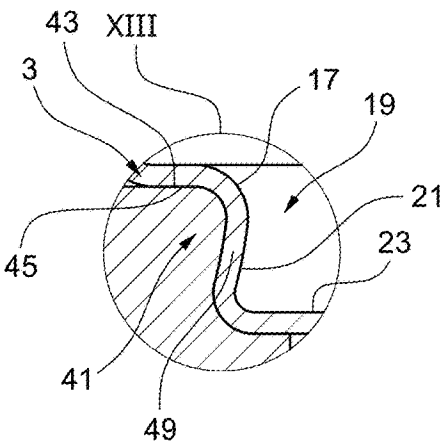
Figure 10:
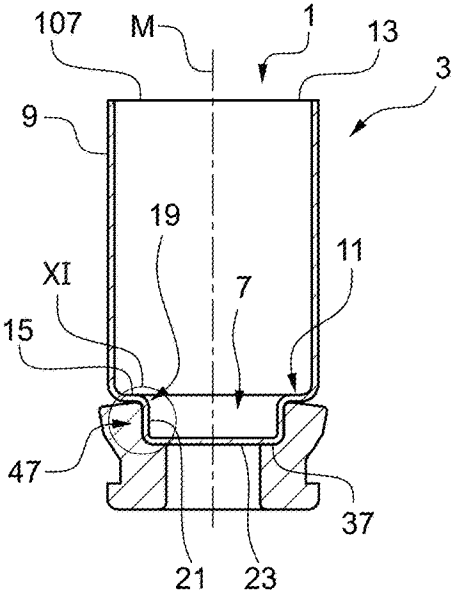

The final assembly condition according to FIGS. 12 and 13 is substantially similar to the final assembly condition according to FIGS. 7 and 8. The case jacket 3 is force and/or form fit to the base piece 5. This has been achieved by plastic deformation by an application of force from the outside to the bending wing 27 in that the latter is bent radially inwards, in particular around the pivot coupling 29, thereby forming an undercut feature 41. At the same time, the bending wing transfers the deformation work applied from the outside to the neck section 11, so that the neck section 11 is deformed to form an undercut 19, i.e. a conical section 49. A deformation restoring force of the case jacket 3, in particular of the neck section 11, counteracting the deformation, reinforces the fastening together of the case jacket 3 and the base piece 5. In all FIGS. 3 to 13, it can be seen that a counter die 107 is arranged in the case jacket 3, in particular substantially exclusively in the cylinder section 9, in particular in order to avoid an undesired deformation of the remaining components or sections of the case jacket 3.

With reference to FIGS. 14 to 18, exemplary embodiments of tools 100 according to the disclosure are described. The tools 100 may be referred to as joining tools, which are configured to produce a cartridge case 1, in particular according to the disclosure, or for joining together the base piece 3 and the case jacket 5.

Figure 14:
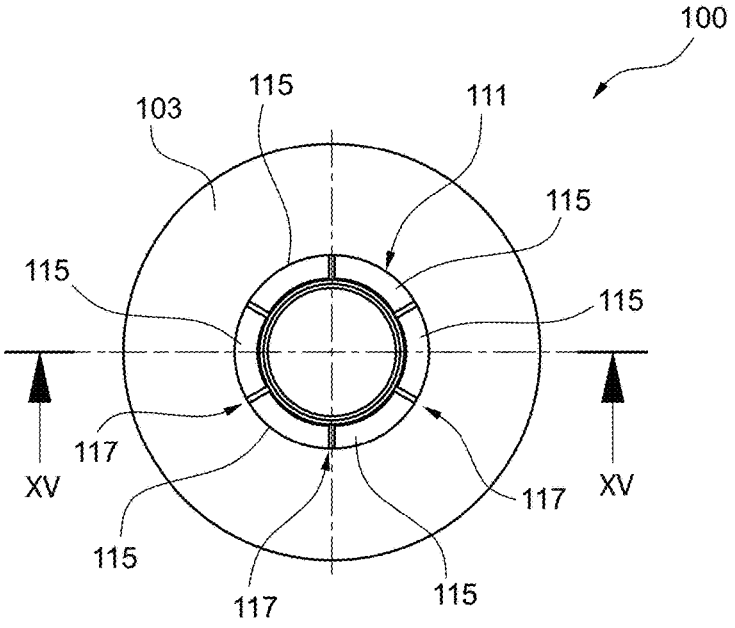
FIG. 14 is a schematic top view of a tool according to an exemplary embodiment of the disclosure.
Figure 15:
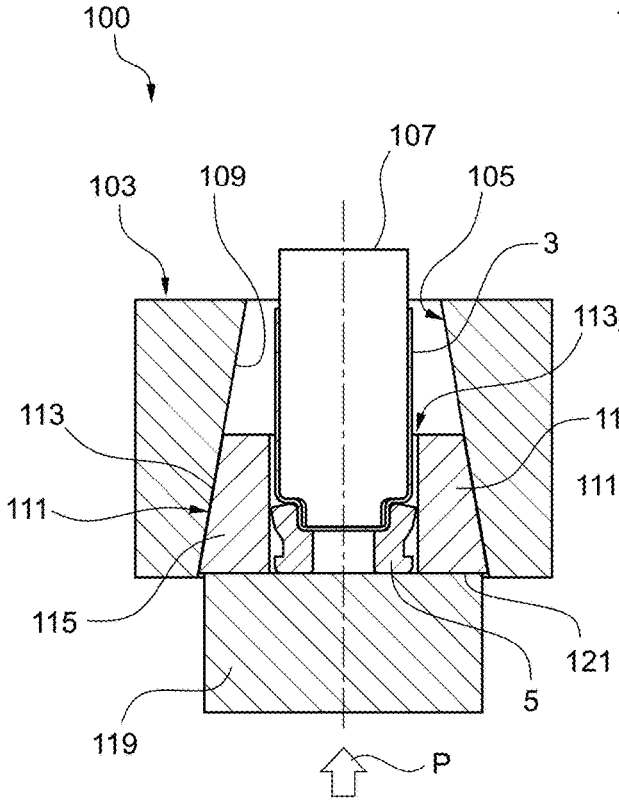
FIG. 15 is a sectional view of the tool according to FIG. 14 with respect to line XV-XV.
Figure 16:
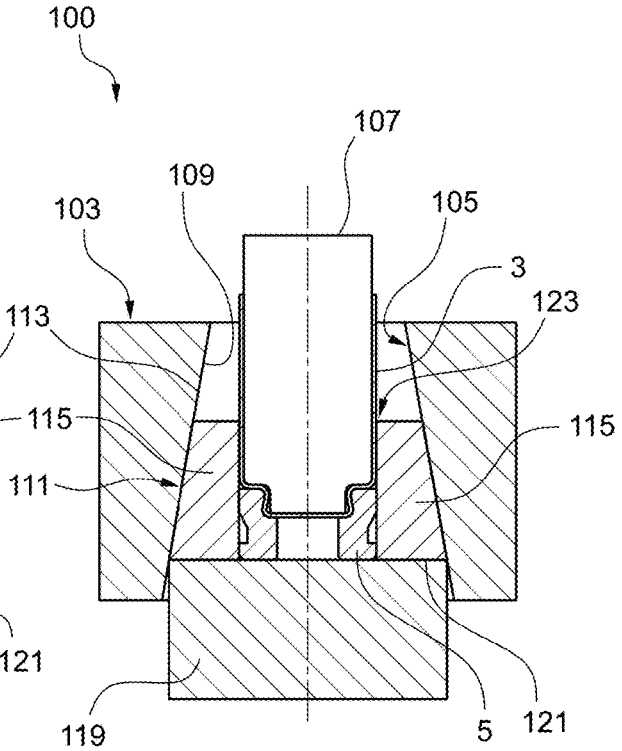
FIG. 16 is a schematic sectional view of the tool of FIGS. 15 to 16 in a further manufacturing state, according to an exemplary embodiment of the disclosure.
Figure 17:
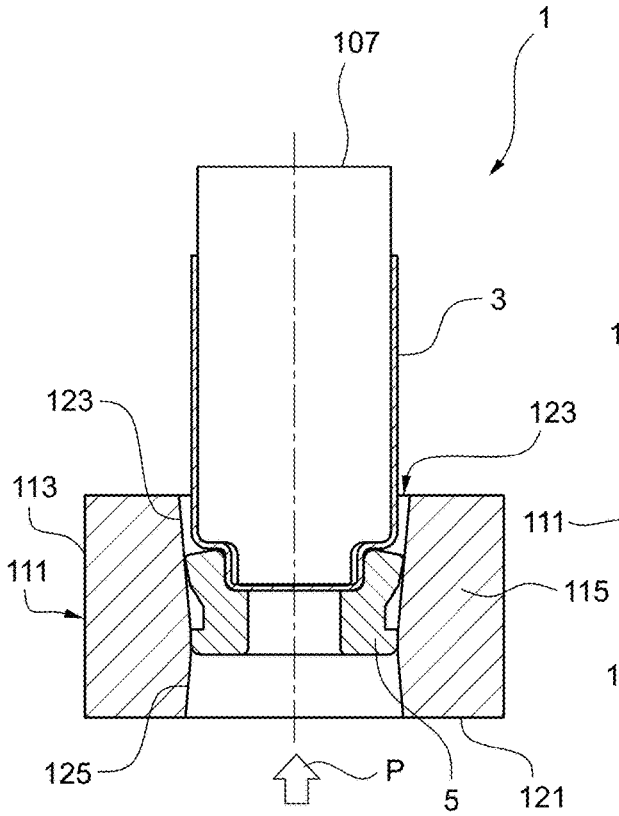
FIG. 17 is a sectional view of a tool, according to an exemplary embodiment of the disclosure, in a prefabrication state.

Under a synopsis of FIGS. 15 to 17, a first embodiment of the joining tool 100 according to the disclosure is apparent. The tool 100 comprises a rotationally shaped shaping die 103 with a central shaping opening 105. As can be seen from FIG. 15, the shaping opening 105 is bounded by an opening wall 109 which is inclined with respect to the central axis M of rotation. The opening wall 109 tapers continuously in the direction from the base piece 5 to the case jacket 3. The opening wall 109 thus delimits a frustoconical shaping opening 105 on the inside. The base piece 5 with already inserted case jacket 3 is arranged inside the shaping opening 105. A rotational press plunger 111 is arranged radially between the forming die 103 and the base piece 5 or the case jacket 3 and has an outer wall 113 adapted to the opening wall 109. FIG. 14 in turn shows that the press plunger 111 consists of, for example, six separate and identically formed plunger segments 115 evenly distributed in the circumferential direction. The plunger segments 115 are each arranged at a distance from one another in the circumferential direction, which is indicated by the reference sign 117. The press plunger 111 may further include an actuating plunger 119 configured to initiate an axial relative pressing motion.

The axial relative pressing movement is apparent from a synopsis of FIGS. 15 and 16, and is indicated by the reference sign P. In the pre-assembly state according to FIG. 15, the actuating plunger 119 is arranged substantially outside the shaping opening 105 and in contact with the base piece 105 and an underside 121 of the plunger segments 115. It is apparent from FIG. 15 that in the pre-assembly state, on the one hand, the bending wings 27 point radially outwards and no undercut feature 41 has yet been formed and also no undercut 119 has yet been formed in the region of the neck section 11 and, on the other hand, that a radial gap 123 exists between the outside of the case jacket 3 and the inside of the press plunger segments 115.

Referring to FIG. 16, the final assembly state in which a cartridge case 1 according to the disclosure has already been produced is illustrated. The actuating plunger 119 is translationally displaced in the axial relative pressing movement direction relative to the shaping die 103, whereby this, on the one hand, also displaces the pressing plunger segments 115 in the axial relative pressing movement direction P and, on the other hand, brings these into deformation engagement with the bending wings 27 of the base piece 5. This is done by the fact that, because of the shape-complementary inclined surfaces sliding against each other, namely the outer side 113 of the pressing plunger segments 115 and the opening wall 109, the pressing plunger segments 115 are forced radially inwardly so that they can apply a deformation force to the bending wings 27 from radially outside. The bending wings 27 thereby deform plastically in such a way that the undercut feature 41 is formed, which at the same time causes an undercut 19 to be generated in the region of the neck section 9. This deformation represents the attachment of the case jacket 3 and the base piece 5 to each other.

Figure 18:
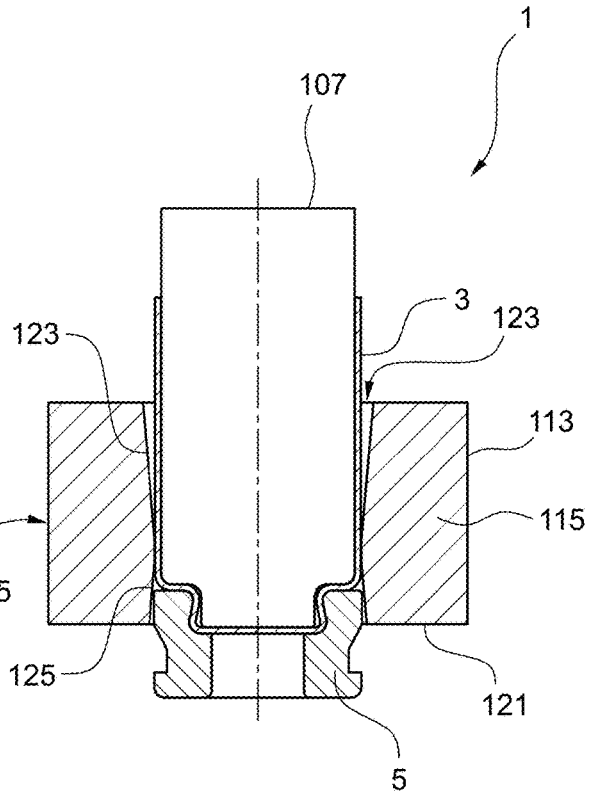
FIG. 18 illustrates the tool according to FIG. 17 in a fabricated state, according to an exemplary embodiment of the disclosure.

With reference to FIGS. 17 and 18, another exemplary embodiment of a tool 100 according to the disclosure is shown, wherein FIG. 17 shows the pre-assembly state and FIG. 18 shows the final assembly state. The principle of joining the base piece 5 and the case jacket 3 by a plastic deformation process of the base piece to form an undercut feature 41 holding the case jacket 3 to the base piece 5 is analogous in the tool 100 according to the disclosure of FIGS. 17 and 18 to the tool according to the disclosure of FIGS. 14 to 16.

From a comparison of the tools 100, it can be seen that the latter differs essentially in the structure and shape of the shaping die 103, in particular with respect to the shaping opening 105. Another essential difference is that, according to the tool 100 of FIGS. 17 and 18, no press plunger 111 is necessary. Furthermore, an additional difference is that according to the tool 100 of FIGS. 17 and 18, the shaping die 103 itself performs the axial relative pressing movement during the shaping process, in contrast to the embodiment of FIGS. 14 and 16, in which the shaping die is arranged stationary (cf. FIGS. 17 and 18). The shaping opening 105 comprises two sections according to FIGS. 17 and 18: a deformation section 123, which essentially performs the plastic deformation of the bending wings; and an output section 125, which essentially serves to allow the manufactured cartridge case 1 to be removed again from the tool 100, in particular from the shaping die 103. The orientation of the inclination of the aperture wall 109 in the region of the deformation section 123 is reversed, as in the output section 125. The opening wall 109 widens in the direction of the axial relative pressing movement, while the opening wall 109 of the output section 125 decreases in the direction of the axial pressing movement direction P.

In the pre-assembly state, the pre-assembly unit comprises the base piece 5 and the inserted case jacket 3 is arranged substantially within the deformation section 123, in particular axially inserted into the shaping opening 105 until the bending wing 27 is in contact with the opening wall 109. For plastic deformation of the bending wings, in particular for radially inward bending to form the undercut feature 41 and to form the undercut 19 in the region of the case jacket 3, the forming die 103 is displaced along the axial relative pressing movement direction P in the direction of the radially widening deformation section 123 or in the direction of the case jacket 103. In the course of the axial relative pressing movement, the shaping die with the inner wall 109 tapering in cross-section, in particular continuously, moves over the bending wing 27 and causes a continuous bending of the bending wing 27 radially inwards. The deformation process is complete when the bending wings are positioned in the area of the output section 125. The output section 125 simplifies the assembly and joining of case jacket 3 and base piece 5 in that the forming die 103 can be displaced further in the axial relative pressing movement direction P until case jacket 3 and base piece 5, i.e. the completely manufactured cartridge case 1, are released.

Figures 19, 20, 21, 22, 23, 24:
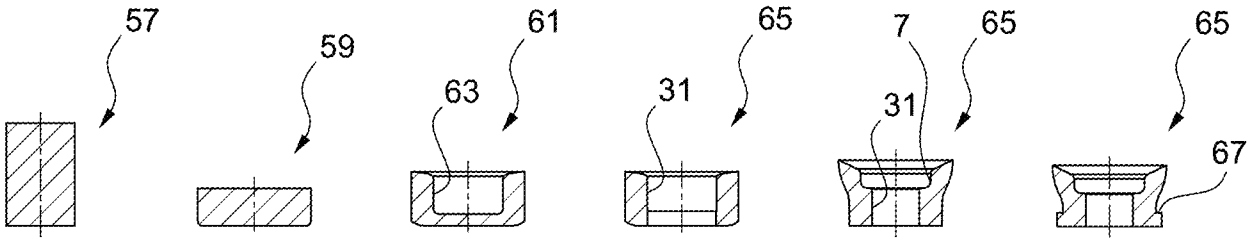
FIGS. 19 to 24 illustrate a manufacturing sequence of a base piece for a cartridge case according to an exemplary embodiment of the disclosure.

With reference to FIGS. 19 to 24, a manufacturing sequence for a base piece 5 of a cartridge case 1 according to the disclosure is described by way of example. First, a metal wire may be provided and cut or cut to length to form a cylindrical wire section 57 (FIG. 19). Then, the wire section 57 is set to form a thick-walled disc 59 (FIG. 20). Alternatively, it is possible to punch a thick-walled metal disk 59 from a blank (not shown). Then, a cup structure 61 with a central internal cavity 63 is produced by backwards extrusion (FIG. 21). The cup structure 61 is then punched to form a ring 65 with a through bore 31 (FIG. 22). In the following two manufacturing steps, the desired inner and outer geometry of the base piece 5 is created (FIG. 24): in FIG. 23, a pressing step for forming the inner geometry is shown. In particular, the recess 7 on the side of the case jacket is formed, into which the case jacket 3 is to be inserted. In the last step (FIG. 24), the extraction groove 67 is also pressed in.

The features disclosed in the foregoing description, the figures and the claims may be of importance both individually and in any combination for the realization of the disclosure in the various embodiments.

REFERENCE LIST

1 Cartridge case
3 Case jacket
5 Base piece
7 Recess
9 Cylinder section
11 Neck section
13 Counter die
15 Support shoulder
17 Transition
19 Undercut
21 Base piece ridge
23 Base
25 case section
27 Bending wing
29 Pivot coupling
31 Through bore
33 Flange
35 Cylindrical section
37 Radial projection
39 Outer wall
41 Undercut feature
43 Inner contour
45 Outer contour
47 Cylinder section
49 Taper section

51 Conical space
53 Clearance
55 End of bending wing
57 Wire section
59 Metal disc
61 Cup structure
63 Internal cavity
65 Metal ring
67 Extraction groove
100 Tool
103 Shaping die
105 Shaping opening
107 Counter die
109 Opening wall
111 Press plunger
113 Outer wall
115 Plunger segment
117 circumferential distance
119 Actuating plunger
121 Underside
123 Radial distance
M Center axis of rotation
P Pressing movement
T Telescopic movement direction

The invention claimed is:

1. A cartridge case for ammunition, comprising:

a rotationally-shaped case jacket configured to receive a projectile, the case jacket having a retaining section; and an annular base piece configured to receive a primer and the case jacket, the annular base piece having an annular wall adjacent to the case jacket being conically shaped at least in sections with respect to an axis of rotation of the annular base piece, wherein the retaining section is configured to engage the base piece on a side of the base piece and adapt in shape thereto so that the retaining section engages, at least in sections, behind the annular wall to fasten the case jacket and the base piece to each other and prevent a distancing of the base piece and the case jacket from each other in a direction of the axis of rotation of the annular base piece, the base piece being configured to plastically deform to form the conically-shaped annular wall and the retaining section.

2. The cartridge case according to claim 1, wherein the annular wall is configured to plastically deform such that the base piece forms an undercut portion and the case jacket is deformed to form an undercut located in a fastening engagement with the undercut portion and/or is adapted in shape at least in sections to the undercut portion.

3. The cartridge case according to claim 2, wherein the base piece comprises a case section facing away from the case jacket and a bending wing which adjoins the case section and is bounded on an inside by the annular wall forming the undercut portion and/or is made in one piece with the case section.

4. The cartridge case according to claim 3, wherein:

the bending wing is connected to the case section via a pivot coupling and/or a predetermined folding point, the bending wing, the pivot coupling, and/or the predetermined folding point and the case section are manufactured from one piece, and/or the pivot coupling and/or the predetermined folding point is realized as a film hinge.

5. The cartridge case according to claim 1, wherein:

the case jacket comprises a hollow cylinder section and an adjoining neck section adjoining the hollow cylinder section and tapering in cross-section with respect to the hollow cylinder section and whose underside facing the base piece is closed at least in sections, and the neck section comprises a thin-walled, planar base wall including solid material for at least 30% of an area of the base.

6. The cartridge case according to claim 1, wherein the case jacket comprises a hollow cylinder section and a neck section adjoining the hollow cylinder section and tapering in cross-section with respect to the hollow cylinder section, the neck section having a support shoulder that extends at least radially, for the base piece and that opens into a conical section widening in cross section in a direction of the base piece.

7. The cartridge case according to claim 1, wherein the base piece includes an annular jacket and a through-bore extending through the annular jacket.

8. The cartridge case claim 7, wherein the base piece further includes:

a bow section on a side of the case jacket, the bow section having a recess configured to receive the case jacket, and/or a stern section on a side of the primer with an opening configure to receive the primer.

9. The cartridge case claim 1, wherein the case jacket has a circumferential jacket and a base facing the annular base piece, the base of the case jacket being closed at least in sections, wherein the base piece is configured to be plastically deformed to fasten the case jacket and the base piece together.

10. The cartridge case according to claim 9, wherein the base of the case jacket comprises a thin-walled, planar wall including solid material for at least 30% of an area of the base of the case jacket.

11. An ammunition comprising:

a cartridge case according to claim 1; and a primer accommodated in the base piece of the cartridge case and/or a projectile accommodated in the case jacket of the cartridge case.

* * * * *